US005421255A

United States Patent [19]

Kryk

[11] Patent Number: 5,421,255

[45] Date of Patent: Jun. 6, 1995

[54] METHOD AND APPARATUS FOR DRIVING A SUBSTRATE IN A PRINTING APPARATUS

[75] Inventor: Gerald M. Kryk, Webster, N.Y.

[73] Assignee: Xerox Corporation, Stamford, Conn.

[21] Appl. No.: 176,270

[22] Filed: Dec. 30, 1993

[51] Int. Cl.[6] ..... G03G 5/00

[52] U.S. Cl. ..... 355/212; 474/85; 101/DIG. 37; 101/DIG. 48

[58] Field of Search ..... 101/DIG. 33, DIG. 37, 101/DIG. 48, 489; 474/84, 85, 86, 87, 88; 355/212, 97, 99, 103

[56] References Cited

U.S. PATENT DOCUMENTS

| | | | |
|---|---|---|---|
| 2,909,074 | 10/1959 | Scheiterlein | 474/86 |
| 3,217,552 | 11/1965 | Daub | 474/87 |
| 4,048,921 | 9/1977 | Raschke | 101/DIG. 37 |
| 4,110,024 | 8/1978 | Gundloch | 101/DIG. 37 |
| 4,114,536 | 9/1978 | Kaneko et al. | 101/DIG. 37 |
| 4,144,808 | 3/1979 | Iwasa et al. | 101/DIG. 37 |
| 4,296,717 | 10/1981 | Schlagmuller | 474/86 |
| 4,846,768 | 7/1989 | Kitami et al. | 474/86 |
| 5,291,251 | 3/1994 | Storlie et al. | 355/271 |

FOREIGN PATENT DOCUMENTS

| | | | |
|---|---|---|---|
| 175859 | 9/1985 | Japan | 474/85 |
| 5-33838 | 2/1993 | Japan | 474/87 |

*Primary Examiner*—Ren Yan

*Attorney, Agent, or Firm*—Finnegan, Henderson, Farabow, Garrett & Dunner

[57] ABSTRACT

An electrostatic printer employing a photoconductive belt wrapped around multiple rollers. A motor drives a first roller. An elastic belt is wrapped around the first roller and a second roller, allowing the first roller to drive the second roller.

19 Claims, 3 Drawing Sheets

METHOD AND APPARATUS FOR DRIVING A SUBSTRATE IN A PRINTING APPARATUS

BACKGROUND OF THE INVENTION

1. Field of the Invention

The present invention relates to method and apparatus for driving a substrate in a printing apparatus and more particularly to a method and apparatus for driving the substrate by transferring power between two members in frictional contact with the substrate.

2. Discussion of the Related Art

A typical document copier includes an electrostatic printer having a moving belt with a photoconductive surface. To transfer an image onto a sheet of paper, the printer charges the belt to a uniform potential, and subsequently exposes the belt to a pattern of light corresponding to the image. Parts of the belt exposed to the light are discharged, resulting in an electrostatic latent image being formed on the belt. The portion of the belt having the electrostatic image then passes a development station that deposits toner on the belt in the pattern of the image, resulting in a toner powder image being formed on the belt. A sheet of paper is then tacked to the belt and then removed from the belt, resulting in an image being formed on the paper.

A cleaning station removes residual toner particles that remain on the belt after the toner image has been transferred to the paper. For example, the cleaning station may include a cleaning blade that scrapes the belt to remove the residual particles from the belt.

A belt driving mechanism typically includes a motor. For good image quality, the belt driving mechanism should move the belt with substantially uniform motion. The belt, however, is subject to frictional forces, opposing the belt driving forces, from the cleaning station, for example. These opposing frictional forces may tend to promote slippage between the belt and the belt driving mechanism, causing a disruption in uniform motion of the belt.

OBJECTS AND SUMMARY OF THE INVENTION

It is an object of the invention to provide a printing apparatus having an improved belt drive mechanism.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims To achieve the objects and in accordance with the purpose of the invention, as embodied and broadly described herein, a method of operating an apparatus having a substrate, a first member in frictional contact with the substrate, and a second member in frictional contact with the substrate, comprises the steps of transferring power from the first member to the substrate; transferring power from the first member to the second member; and transferring power from the second member to the substrate.

According to another aspect of the present invention, an assembly for a printing apparatus comprises a motor; a first roller coupled to the motor; a second roller; a first belt, having a first width, on the first and second rollers; and a second belt, having a width smaller than the first width, on the first and second rollers.

According to yet another aspect of the present invention, an assembly for a printing apparatus, comprises a first roller; a second roller; a third roller; a first belt, having a first width, on the first, second, and third rollers; and a second belt, having a width smaller than the first width, on the first and second rollers, and off the third roller.

BRIEF DESCRIPTION OF THE DRAWINGS

The accompanying drawings, which are incorporated in and which constitute a part of this specification, illustrate one embodiment of the invention and, together with the description, explain the principles of the invention. In the drawings.

DESCRIPTION OF THE PREFERRED EMBODIMENTS

Figure 1:
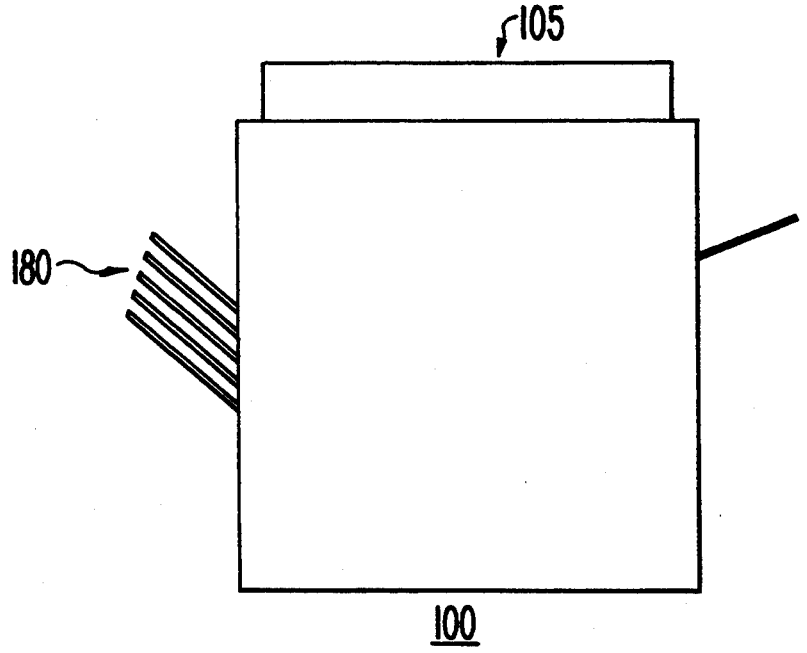
FIG. 1 is a side view of the exterior of a copier according to the preferred embodiments of the present invention.

FIG. 1 shows the exterior of a copier 100, including an electrostatic printer, of the preferred embodiments of the present invention. Copier 100 includes a document feeder 105 for transporting an original document to a platen where the copier scans the original document. Copier 100 then duplicates the original document image onto a sheet of paper and transports the sheet of paper to paper output tray 180.

Figure 2:
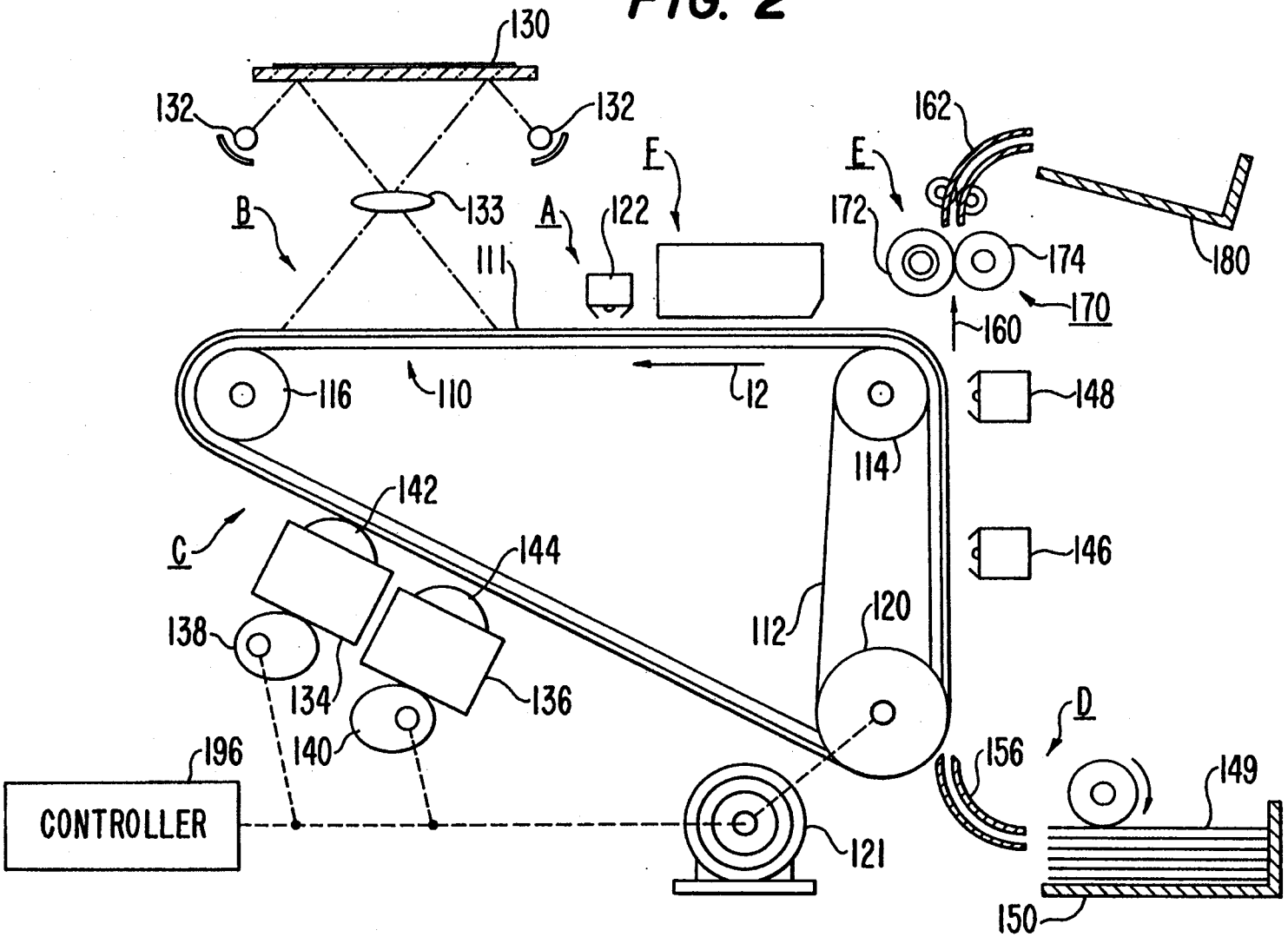
FIG. 2 is a schematic elevational view depicting various operating components of the copier shown in FIG. 1, in accordance with a first embodiment of the present invention.

FIG. 2 shows the interior of copier 100. A belt 110 has a photoconductive surface 111. Belt 110 is entrained about a stripping roller 114, a tension roller 116, and a drive roller 120. Stripping roller 114, tension roller 116, and driving roller 120 are rotatably mounted. A pair of springs (not shown) maintain belt 110 in tension by resiliently urging tension roller 116 against belt 110.

Motor 121 drives driver roller 120, which drives belt 110. Roller 120 drives elastic belt 112, which drives stripping roller 114. Thus stripping roller 114 also drives belt 110. In other words, motor 121 transfers power to driving roller 120, driving roller 120 transfers power to belt 110 and stripping roller 114, and stripping roller 114 transfers power to belt 110.

Figure 3:
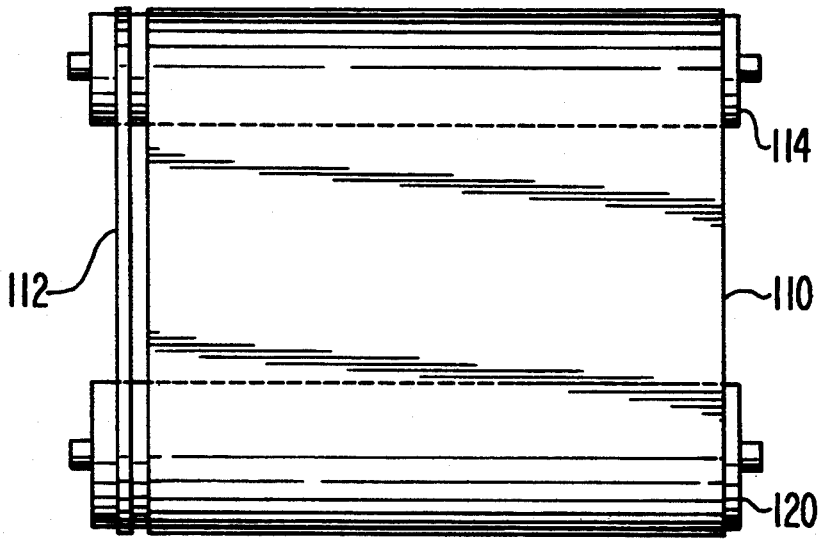
FIG. 3 is an end view of some of the operating components shown in FIG. 2.

As shown in FIG. 2, the circumference of elastic belt 112 is less than the circumference of belt 110 as elastic belt 112 is on driver roller 120 and stripper roller 114 but is off tension roller 116. As shown in FIG. 3, the width of belt 110 is greater than the width of elastic belt 112 as belt 110 must have sufficient width to accommodate a piece of paper.

Belt 110 moves in the direction of arrow 12 to advance successive portions of belt 110 sequentially through various processing stations disposed about the path of movement of belt 110. Initially a portion of belt 110 passes through charging station A, where a corona device 122 charges a portion of belt 110 to a relatively high, substantially uniform, potential, either positive or negative.

At exposure station B, flash lamps 132 illuminate an original document on transparent platen 130. Lens 133 projects light rays reflected from the original document onto the charged portion of belt 110 to selectively discharge the charge on belt 110. This selective discharging records an electrostatic latent image, corresponding to an image on the original document, on belt 110. Alternatively, a laser may be provided to selectively discharge belt 110 in accordance with stored electronic information.

Belt 110 then advances the electrostatic latent image to development station C. Development station C includes two developer housings 134 and 136 for contacting belt 110 to develop the electrostatic latent image. Cams 138 and 140 move housings 134 and 136 into and out of developing position. Motor 121 selectively drives cams 138 and 140. Each developer housing 134 and 136 supports a developing system including brush rolls 142 and 144, which each includes a rotating magnetic member for advancing developer mix, carrier beads and toner, into contact with the electrostatic latent image. The electrostatic latent image attracts toner particles from the carrier beads to form a toner powder image on belt 110. If only one color of developer material is required, the second developer housing may be omitted.

A sheet of paper 149 advances from supply tray 150 to transfer station D along conveyor 156. Belt 110 advances the toner powder image to transfer station D, where the sheet of paper contacts the powder image on belt 110. A corona generator 146 charges the paper to a potential such that the paper becomes tacked to belt 110 and the toner powder image is attracted from belt 110 to the paper. A corona generator 148 then charges the paper such that the paper becomes detached from belt 110, allowing stripping roller 114 to remove the paper from belt 110.

Subsequently, the paper moves in the direction of arrow 160 to fusing station E. Fusing station E includes a fuser assembly 170 that permanently affixes the transferred toner powder image to the paper. Fuser assembly 170 includes a heated fuser roller 172 and a backup roller 174 for pressure engaging the toner powder image, which contacts fuser roller 172. The paper then advances through a shoot 162 to paper output tray 180.

Cleaning station F removes residual particles remaining on the photoreceptor belt 110 after each copy is made. Cleaning station F includes a primary cleaning blade that removes the majority of the residual particles from the surface of belt 110, and a secondary blade that accumulates particles not removed by the primary blade.

Elastic belt 112 allows roller 114 to drive belt 110, resulting in increased roller driving area in frictional contact with belt 110. This increase is especially important in systems having design constraints that limit the extent to which the photoconductive belt can wrap around the primary driving roller. The less the extent of wrap, the less of the primary driving roller that is in frictional contact with the belt.

The extent of wrap around a roller is quantifiable in terms of the amount of circumference of the roller that is in contact with the belt at any given time. More specifically, a wrap angle $\alpha$ is defined by the rotation axis of the roller and the portion of the circumference of the roller that is in contact with the belt at any given time.

Figure 4:
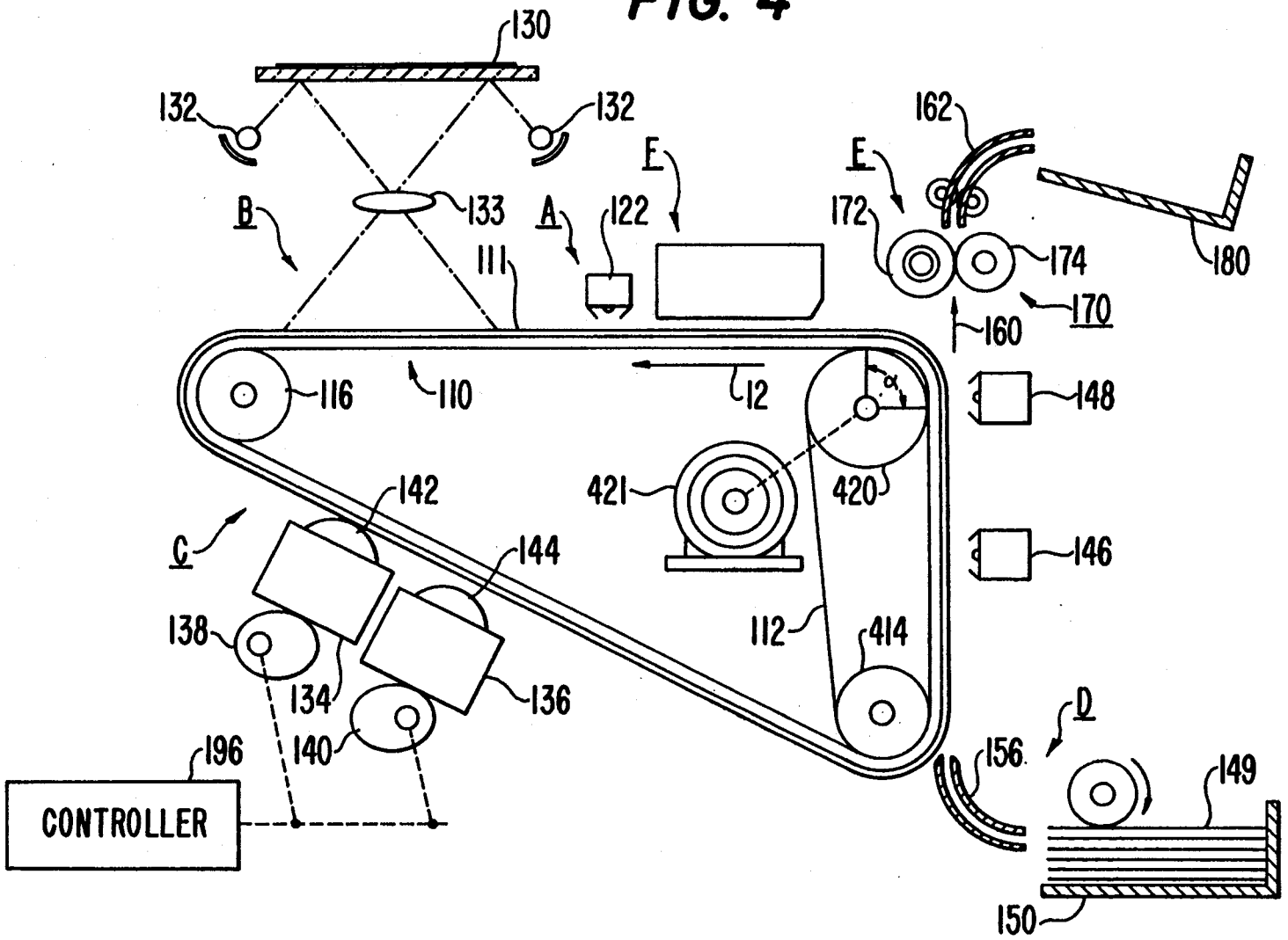
FIG. 4 is a schematic elevational view depicting various operating components of the copier shown in FIG. 1, in accordance with a second embodiment of the present invention.

FIG. 4 shows a second embodiment of the present invention. In FIG. 4, components corresponding to components of the first embodiment of the present invention are designated by corresponding reference numbers. The second embodiment differs from the first embodiment in the placement of the primary driver roller 420 and the resulting wrap angle of primary driver roller 420. As shown in FIG. 4, the wrap angle $\alpha$ of primary driver roller 420 is no greater than 90°, while the wrap angle of driver roller 120 shown in FIG. 2 is greater than 90°. If elastic belt 112 were not present, this reduced wrap angle might result in slippage between primary driver roller 420 and belt 110. Since the alternative embodiment does include elastic belt 112, however, the total drive wrap angle includes the wrap angle of roller 414, resulting in additional roller driving area in frictional contact with belt 110.

An additional advantage of the preferred embodiments of the present invention is that elastic belt 112 adds an extra degree of control of the tension of belt 110. More specifically, the tension of the photoreceptor belt 110 may be controlled by controlling the pulley diameter ratio between photoconductive belt 110 and elastic belt 112, controlling the neutral access ratio between elastic belt 112 and photoconductive belt 110, or varying the elasticity of elastic belt 112.

This increased degree of control allows for isolated tension zones on belt 110 to achieve increased flatness of belt 110 in the tension zones, allowing for more accurate placement of an image on the belt. This more accurate placement is especially beneficial in single pass full color printers, which require especially accurate placement of overlying multiple images corresponding to each color component. Localizing the tension to certain areas of the belt relieves stress on other parts of the copier such as roller bearings.

Thus, the preferred embodiments of the present invention allow for enhanced image quality by providing a more reliable belt drive and a greater degree of control of photoconductive belt tension.

Additional advantages and modifications will readily occur to those skilled in the art. The invention in its broader aspects is therefore not limited to the specific details, representative apparatus, and illustrative examples shown and described. Thus, various modifications and variations can be made to the present invention without departing from the scope or spirit of the invention, and it is intended that the present invention cover the modifications and variations provided they come within the scope of the appended claims and their equivalents.

We claim:

1. A printing apparatus having a charging station, an exposure station adjacent to the charging station, a developing station adjacent to the exposure station, a paper transfer station adjacent to the developing station, and an image transfer station adjacent to the paper transfer, the apparatus comprising:

a first belt having a first width;

means for advancing the first belt through the charging station, the exposure station, the developing station, the paper station, and the image transfer station, the advancing means including:

first and second rollers spaced from each other, the first belt being disposed on the first and second rollers;

a second belt, having a second width, disposed on the first and second rollers; and a motor for driving the first roller, said first roller in turn driving the second roller through the second belt.

2. The printing apparatus according to claim 1, wherein the first belt has a first circumference, and the second belt has a circumference smaller than the first circumference.

3. The printing apparatus according to claim 1, wherein the first belt includes a photo-conductive surface portion.

4. The printing apparatus according to claim 1, wherein the second belt includes an elastic material.

5. The printing apparatus according to claim 1, wherein the first roller defines:

an axis, and a circumference having a portion in contact with the first belt at a given time, wherein an angle defined by the axis and the contact portion is no larger than 90 degrees.

6. The printing apparatus according to claim 1, wherein the first roller has a first diameter and the second roller has a second diameter different from the first diameter.

7. The printing apparatus according to claim 1, further comprising a third roller, the first belt disposed on the third roller and having a triangular shape about the first, second and third rollers.

8. A printing apparatus comprising:

a first belt having a first width;

a charging station including means for charging a portion of the first belt;

an exposure station including means for recording a latent image on the portion of the first belt;

a developing station includes means for forming a toner image corresponding to the latent image on the portion of the first belt;

a paper station including means for advancing a paper onto the first belt;

an image transfer station including means for transferring the toner image onto the paper; and means for advancing the portion of the first belt through the charging station, the exposure station, the developing station, the paper station, and the image transfer station, the advancing means including:

first and second rollers spaced from each other, the first belt being disposed on the first and second rollers;

a second belt, having a second width, disposed on the first and second rollers; and a motor for driving the first roller, said first roller in turn driving the second roller through the second belt.

9. The printing apparatus of claim 8, further comprising a third roller, the first belt being disposed on the third roller and having a triangular shape about the first, second and third rollers.

10. The printing apparatus of claim 8, wherein the first belt has a photoconductive surface.

11. The printing apparatus of claim 8, wherein the first roller has a first circumference and the second roller has a second circumference, the second circumference being smaller than the first circumference.

12. The printing apparatus of claim 8, wherein the second belt includes an elastic material.

13. The printing apparatus of claim 8, wherein the first width of the first belt is wider than the second width of the second belt.

14. The printing apparatus of claim 8, wherein the second belt contacts the first and second rollers at locations other than where the first belt contacts the first and second rollers.

15. The printing apparatus of claim 8, wherein the first belt wraps around the first roller in an arc corresponding to less than 90 degrees.

16. The printing apparatus of claim 8, wherein the first belt wraps around the first roller in an arc corresponding to greater than 90 degrees.

17. The printing apparatus of claim 8, further comprising a cleaning station including means for removing residual particles from the first belt.

18. The printing apparatus of claim 8, wherein the motor also controls the developing station.

19. The printing apparatus of claim 8, wherein the image transfer station includes a fusing station having means for permanently affixing the toner power image to the paper.

* * * * *

UNITED STATES PATENT AND TRADEMARK OFFICE

CERTIFICATE OF CORRECTION

PATENT NO. : 5,421,255

DATED : June 6, 1995

INVENTOR(S) : Kryk

It is certified that error appears in the above-indentified patent and that said Letters Patent is hereby corrected as shown below:

Claim 1, column 4, line 58, after "transfer" insert --station--.

Claim 3, column 5, line 8, change "photo-conductive" to --photoconductive--.

Signed and Sealed this

Twenty-fifth Day of July, 1995

Bruce Lehman

*Attest:*

BRUCE LEHMAN

*Attesting Officer*

*Commissioner of Patents and Trademarks*